United States Patent [19]

Kurz

[11] Patent Number: 4,670,352

[45] Date of Patent: Jun. 2, 1987

[54] TEARABLE STRUCTURE

[75] Inventor: John H. Kurz, Scottsdale, Ariz.

[73] Assignee: Canada Cup, Inc., Toronto, Canada

[21] Appl. No.: 915,496

[22] Filed: Oct. 6, 1986

Related U.S. Application Data

[63] Continuation-in-part of Ser. No. 785,962, Oct. 10, 1985, abandoned.

[51] Int. Cl.[4] ..... B65D 65/26; B65D 17/28; B65D 17/32; B26F 3/02

[52] U.S. Cl. ..... 428/571; 428/603; 428/43; 225/2; 206/604

[58] Field of Search ..... 428/571, 572, 599, 603, 428/606, 43; 225/1, 2; 206/604, 605, 620, 628

[56] References Cited

U.S. PATENT DOCUMENTS

| | | | |
|---|---|---|---|
| 1,803,348 | 5/1931 | Pasurka | 206/620 |
| 2,750,102 | 6/1956 | Thurman | 206/620 |
| 3,170,619 | 2/1965 | Repko | 206/604 |
| 3,403,840 | 10/1968 | Mathes | 206/605 |
| 3,411,706 | 11/1968 | Mela | 206/620 |
| 3,618,850 | 11/1971 | Palmer | 206/620 |

*Primary Examiner*—Melvyn J. Andrews
*Assistant Examiner*—John J. Zimmerman
*Attorney, Agent, or Firm*—Bachman & LaPointe

[57] ABSTRACT

A method for tearing a thin sheet material and a tearable thin sheet material having a predetermined tear line wherein the material is corrugated along a predetermined tear line to be torn. The corrugations have at least one edge, a base and an apex and the material is torn along said edge.

24 Claims, 6 Drawing Figures

TEARABLE STRUCTURE

CROSS-REFERENCE TO RELATED APPLICATIONS

This application is a continuation-in-part of copending U.S. patent application Ser. No. 785,962, By John H. Kurz, for Tearable Structure, filed Oct. 10, 1985 now abandoned.

BACKGROUND OF THE INVENTION

The present invention relates to thin sheet material which can be readily torn along a predetermined tear line while retaining its integrity until the material is torn. Such structures are highly desirable for a variety of uses. For example, aluminum foil is customarily used to cover frozen foods and often portions thereof must be selectively torn for food preparation. Flexible plastic sacs or pouches containing food must be opened quickly and easily to release the contents. A particular use is for plastic lids commonly used with rigid containers, such as cups, tubs, jars, cans and the like. For example, all kinds of drinks are currently being dispensed in plastic and paper containers commonly being covered with openable lids. A problem is often encountered with spillage when the lid has been opened. For cold drinks the problem has been often reduced by providing a selectively opened straw orifice in the lid; however, this is mostly undesirable as most users prefer to drink from a substantial opening rather than through a straw.

A variety of flip open lids have been developed, as shown for example in U.S. Pat. Nos. 3,994,411, 3,977,559, 4,210,272, 4,202,459, 4,412,629, 4,090,660 and 4,285,442. However, these rely on the principle of scoring the lid along a predetermined line and hence weakening the material at the score site. This undesirable weakening could result in leakage of the contents of the container or accidental opening of the tear top with possible spillage.

Therefore, it is particularly desirable to provide a tearable structure which is tearable along a predetermined tear line without weakening the base structure. It is an object of the present invention to provide such a tearable structure made of plastic, aluminum or a laminated composite thereof and also a method for tearing a thin sheet material along a predetermined tear line.

It is an additional object of the present invention to provide a variety of such tearable structures, such as container lids, plastic pouch packages, metal foil, and to provide such structures which are not characterized by a weakened tear line as with a scored tear line, and which can be uniformly and reliably torn at a desired location.

Further objects and advantages of the present invention will appear hereinbelow.

SUMMARY OF THE INVENTION

In accordance with the present invention it has now been found that the foregoing objects and advantages can be obtained.

The present invention encompasses a tearable structure and a method for the manufacture thereof in which the direction of the propagation of a tear caused by an external force is determined by the difference in brittleness in at least two directions, whereby the said tear propagates in the direction of greater brittleness wherein the said directional difference in brittleness is induced by orientation. "Orientation", as used above and subsequently herein means the alignment in a given direction of atoms, molecules, crystallites, clusters thereof and like "building blocks" of matter, not visable to the naked eye. Orientation may be obtained by a variety of means, as for example by directional differentials in cooling, by the application of magnetic fields and by deformation. In the present context orientation is meant to describe a process of deforming by means of stretching an article made of plastic, e.g. a sheet; or of metal, particularly aluminum, e.g. a foil, predominantly in one direction, with the result that its molecules, or crystallites, as the case may be, become preferentially aligned in said direction. Orientation in which such single-directional predominance prevails is termed uniaxial orientation.

In order to be effective, stretching must be carried out within a temperature range that permits orientation to occur, which varies from one material to another. The effect of orientation is a change in mechanical and other properties, such as tensile strength and ductility the extent of such change being dependent upon the temperature at which stretching occurs and the extent thereof.

In particular, the method of the present invention is a method for tearing an article made of thin sheet material along a predetermined line which comprises: providing a thin sheet of orientable material; orienting the said sheet uniaxially along a predetermined line to be torn, preferably by forming a plurality of corrugations in said material along said predetermined line to be torn, wherein said corrugations have at least one edge, a base and an apex; providing a marginal edge in said material; providing means, as a tab or notch, in said marginal edge adjacent the area of said orientation and adjacent said edge for directing a tear towards the area in which said orientation commences, such as a first of said corrugations; and tearing said material along the line of orientation, as along said edge of said corrugations, including starting the tear from said means, to provide a clean tear along the said predetermined line.

The article can be made of orientable material, for example, a plastic material, as for example in a container lid, or in a flexible plastic pouch, or of metal, as in aluminum foil. Uniaxial orientation by stretching predominantly in a single direction may be imparted to the material by corrugating the sheet which is the preferred embodiment. Other means to provide such predominantly uniaxial orientation are well known. It is formal that corrugation is a preferred means to effect uniaxial orientation. The corrugation can have a trapezoidal shape or a substantially triangular shape with a curved, flat or fairly sharp apex. The angle between the base and apex may reach 90 degrees and should preferably stay between 15 and 40 degrees.

The present invention also contemplates a tearable, thin sheet material having a predetermined tear line which comprises: a thin sheet of orientable material having a marginal edge; uniaxial orientation in said sheet along a predetermined line to be torn, preferably provided by a plurality of corrugations in said material along said predetermined line to be torn with a first of said corrugations adjacent said marginal edge, wherein said corrugations have at least one edge, a base and an apex; means as a tab or notch in said marginal edge adjacent the area of said orientation and preferably adjacent the first of said corrugations, to provide a clean tear line along said predetermined line. While corrugations are preferred to secure the necessary predominance of uniaxial orientation to the desired direction of tearing, stretching alone in that direction may be used, providing that the desired tear line is not substantially curved.

The method and article of the present invention has numerous and significant advantages. A sharp and accurate tear line is provided without the disadvantages of a score line which is the most frequently used tear inducing means. There is no weakening of the article of the present invention before tearing. In fact, the increased strength of the material due to orientation at the corrugations enhance its resistance to surface pressure. In addition, there is no danger of leakage or accidental opening before tearing as there is with a score line. Further, the formation of the corrugations is simple and convenient and does not require delicate tool adjustments as is required with a score tool to avoid cutting through the material if the score is too deep or forming an inadequate score if too shallow. Further, the tear in the present invention is surprisingly easy to make and fully accurate.

The present invention is applicable to a variety of orientable materials and to thin sheet articles made therefrom, as for example polystyrene, polypropylene, polyethylene terephthalate (PS, IPS, PP, PVC, PET) and other plastic; aluminum, and other metals available as soft foil.

Further advantages and features of the present invention will appear hereinbelow.

BRIEF DESCRIPTION OF THE DRAWINGS

The present invention will be more readily understandable from a consideration of the following illustrative drawings wherein.

DETAILED DESCRIPTION

Figure 1:
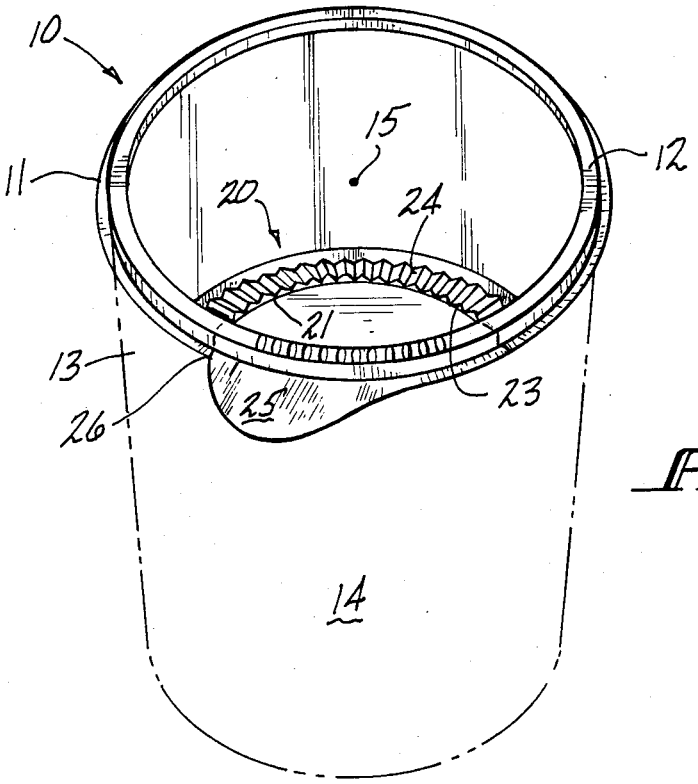
FIG. 1 is a perspective view of a container lid having a corrugated, predetermined tear line of the present invention with the cup shown in phantom.

FIG. 1, which respresents one embodiment of the present invention, shows a disposable lid 10 formed of thin sheet plastic which is circular in shape having a marginal edge 11 and a peripheral groove 12 on the underside thereof for snap-fitting on the upper edge 13 of a conventional, disposable drinking cup 14 (shown in phantom) such as is made of plastic or coated paper. Central venting means 15 is provided in the lid.

Figure 2A:
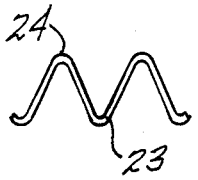
FIG. 2A is an alternate embodiment of corrugations similar to FIG. 2.
Figure 2:
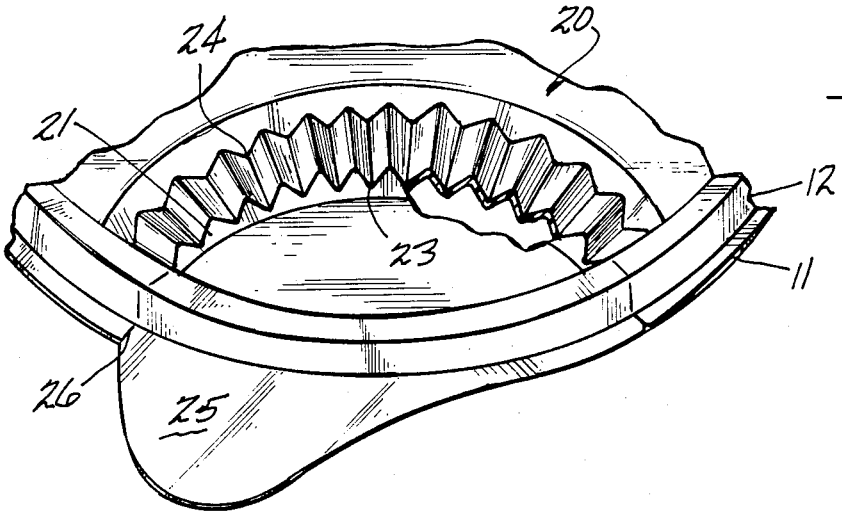
FIG. 2 is an enlarged sectional view along lines 2—2 of FIG. 1 showing a detail of the corrugations.

Lid 10 is provided with a plurality of corrugations 20 in a semi-circular pattern defining a removable portion of the lid along a predetermined tear line corresponding to the corrugations. The corrugations have at least one edge 21, a base 23 and an apex 24 and can be formed with a variety of configurations, as with the apex 24 sharply curved as shown in FIG. 2 or with the apex 24 flattened in a trapezoidal shape as shown in FIG. 2A.

Means are provided in the marginal edge to direct a tear towards the corrugations. These means may be a tab or a notch or both. In the embodiment shown in FIG. 1 tab 25 and notch 26 is formed in marginal edge 11 adjacent a first of said corrugations 20 and adjacent said edge 21.

In accordance with the method of the present invention the tear is initiated at the tab 25 and/or notch 26 and propagates along the adjacent edge 21. Thus, the user simply grasps tab 25 and commences the tearing action from the edge of the tab towards the beginning of the corrugations and from then on along the circle defined by the line of corrugations, i.e., along a predetermined line. As shown in FIG. 1, a notch 26 is preferably provided at the base of the tab so that upon lifting the tab it will tear only into the said notch rather than along its own limiting diameter.

Figure 3:
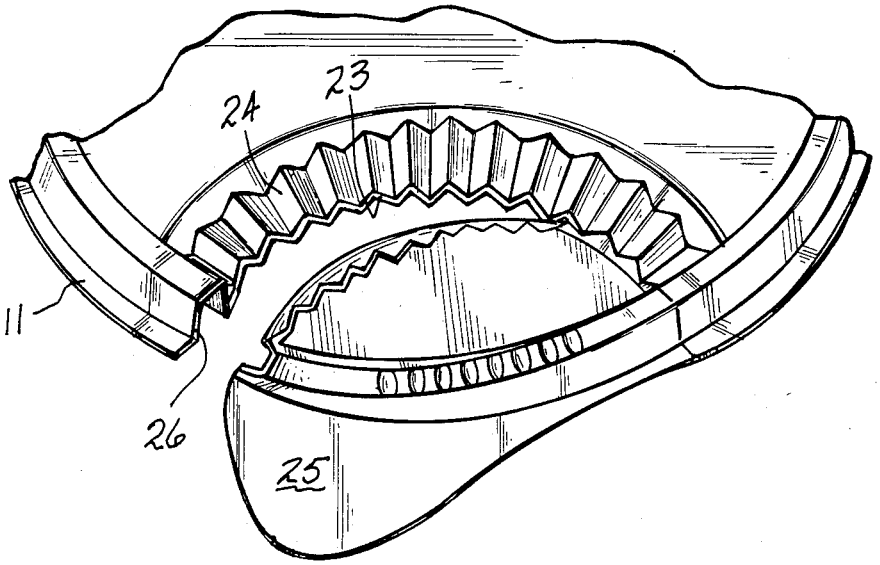
FIG. 3 shows the structure of FIG. 1 in a partially torn state.

FIG. 3 shows the corrugations in the process of being torn. The characteristic of the present invention in relation to the tab is in that the tear propagates in two directions sequentially, once radially over the rim of the lid and then tangentially to the apex 24 of the corrugations 20 and along the corrugations. It has been observed that the above described tear propagates in the following manner: when a pulling force is applied, as shown in FIG. 3, the apex 24 of the last attached corrugation remains attached until the next adjoining base 23 opens a crack. This is caused by the geometry of the sequential corrugations and is given by the fact that a difference in the degree of orientation exists within the material in the apex and the bottom, so that the apex can be formed more than the next adjoining bottom region, causing the latter to tear before the former. Due to this feature, the tear is pre-directed as soon as the material in the apex is severed. Thereby the primary aim of weakening any structure for purposes of tearing is satisfied, namely to direct the tear in a predetermined manner rather than to allow accidental and random tear directions to be assumed. Random tearing is primarily precluded by the fact that the structure is extremely rigid across the corrugated section and weak only on the precise line at which the corrugations stop.

An important characteristic is the angle formed between the base and apex. It has been found that it should preferably not exceed 90° and preferably be between 15° and 40°.

In accordance with the present invention it has been found that the line of corrugations provide a sharp tear along a predetermined line. The corrugations not only fail to weaken the structure, but actually enhance its resistance due to their geometry. At the same time it has been found that a force applied along the tangent of the circle formed by the corrugation will cause a tear to propagate with great facility and reliability along the said circle. This should be sharply contrasted with the conventional use of score lines which disadvantageously weaken the structure and often fail to preclude tearing away from the score.

The corrugations can be readily formed as for example by thermoforming or by embossing a great variety of orientable thin sheet materials such as the plastics, and metal foil, referred to above.

Figure 4:
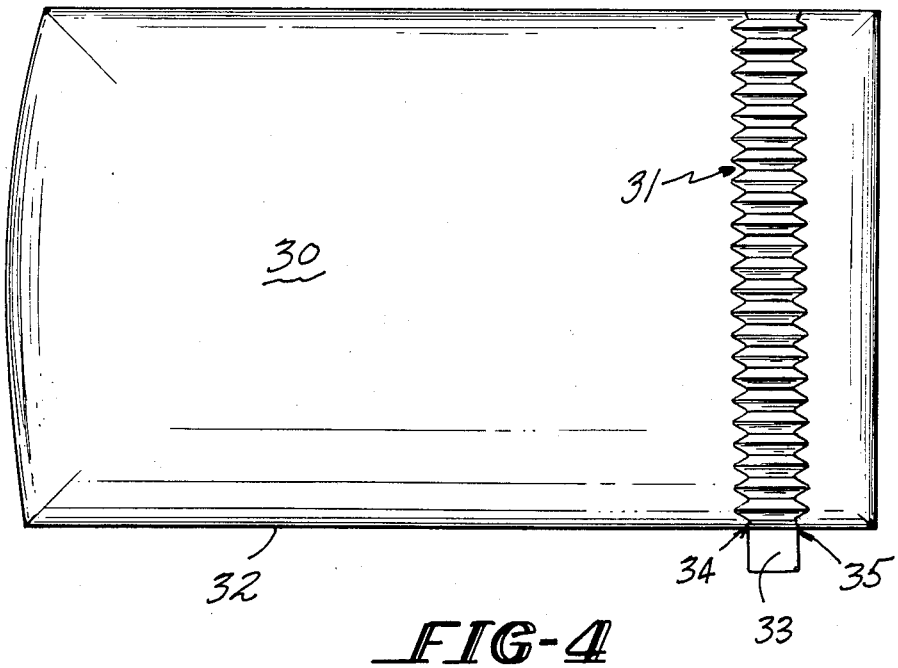
FIG. 4 shows a flexible plastic pouch having a corrugated, predetermined tear line of the present invention.

The principle of the present invention is then readily applied to such thin sheet materials, generally used in packaging where easy opening is desired. FIG. 4 shows a hermetically sealed pouch package 30 formed from flexible plastic material. Corrugations 31 extend across the package to marginal edge 32. Tab 33 having notches 34 and 35 at the base thereof is formed in marginal edge 32 adjacent a first of said corrugations to direct a tear towards the corrugations in a manner after FIGS. 1–3. Thus, it will be seen that in accordance with this embodiment tearing along two edges of the corrugations results in a clean tear along a predetermined tear line formed by the corrugations and a simple and convenient method for opening the hermetically sealed package. Heretofore it has been necessary to use scissors to open the package. Alternatively, so-called tear strips have been applied or weakened sections by scoring or thinning. Tear strips are narrow, strong ribbons of a material other than that of the package, usually a strong plastic and occasionally a metal, which are attached to the package by adhesives or heat sealing and which, when pulled, will not detach from the package but instead will tear it open. However, tear strips are by and large unreliable and tend to provide an incomplete opening. Similarly, thinning or weakening tends to be unreliable and may cause other problems.

Figure 5:
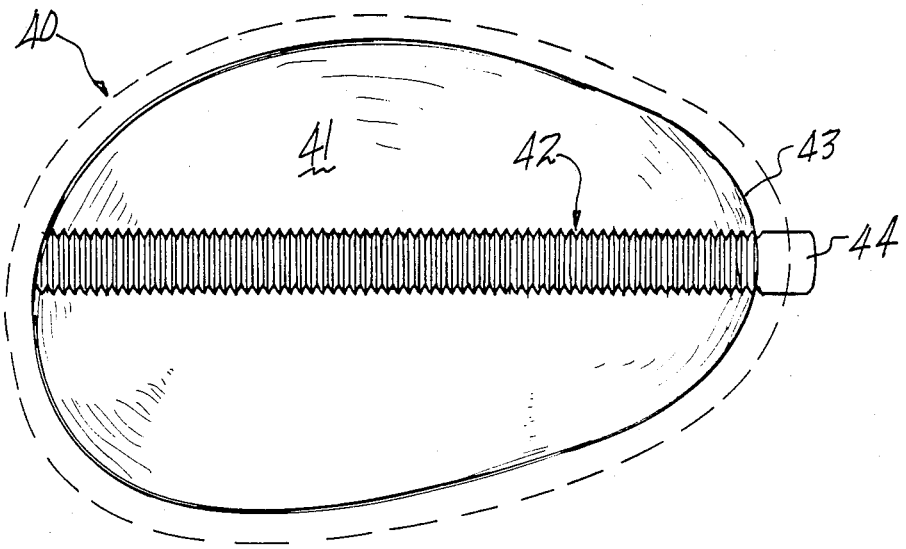
FIG. 5 shows an aluminum foil covering having a corrugated, predetermined tear line of the present invention.

The embodiment of FIG. 5 shows a package 40 covered with aluminum foil 41 having corrugations 42 extending thereacross to marginal edge 43. Tab 44 is provided on the marginal edge 43 adjacent a first corrugation as in FIGS. 1–4 so a tear commenced by tab 44 will propagate along the line of corrugations in a manner after the embodiment of FIG. 4. This is particularly useful with frozen foods where a well-defined, predetermined tear line is desired to leave a portion of the contents covered during the heating process.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A method for tearing a thin sheet material along a predetermined line which comprises: providing a thin sheet of orientable material; orienting the said sheet uniaxially along a predetermined line to be torn; providing a marginal edge in said material; providing means in said marginal edge adjacent the area of said orientation and adjacent said edge for directing a tear towards the area in which said orientation commences; and tearing said material along said line of orientation including starting the tear from said means, to provide a clean tear along the said predetermined line.

2. A method according to claim 1 wherein a plurality of corrugations are formed along a predetermined line to be torn, wherein said corrugations have at least one edge, a base and an apex, wherein the means in said marginal edge is adjacent a first of said corrugations for directing a tear towards said corrugations, and tearing said material along said edge of said corrugations.

3. A method according to claim 1 wherein said means is a tab.

4. A method according to claim 1 wherein said means is a notch.

5. A method according to claim 2 wherein said material is a plastic.

6. A method according to claim 5 wherein said material is a thermoformed container lid.

7. A method according to claim 2 wherein the angle between the base and the apex does not exceed 90°.

8. A method according to claim 2 wherein the angle between the base and the apex lies between 15° and 40°.

9. A method according to claim 1 wherein said sheet is oriented uniaxially along a predetermined line to be torn by stretching predominantly in a single direction.

10. A method according to claim 1 wherein said orientation enhances resistance to surface pressure without weakening the structure.

11. A method according to claim 1 wherein said uniaxial orientation includes preferentially aligning the molecules of said sheet material in a single direction along said predetermined line.

12. A tearable thin sheet material having a predetermined tear line which comprises: a thin sheet of orientable material having a marginal edge; uniaxial orientation in said sheet along a predetermined line to be torn; means in said marginal edge adjacent the area of orientation to provide a clean tear line along said predetermined line.

13. A sheet material according to claim 12 including a plurality of corrugations in said material along a predetermined line to be torn with a first of said corrugations adjacent said marginal edge, wherein said corrugations have at least one edge, a base and an apex, wherein the means in said marginal edge is adjacent a first of said corrugations and adjacent said edge of said first corrugation to provide a clean tear line along said predetermined line.

14. A material according to claim 12 wherein said means is a tab.

15. A material according to claim 12 wherein said means is a notch.

16. A material according to claim 13 wherein said material is a rigid plastic.

17. A material according to claim 17 wherein said material is a thermoformed container lid.

18. A material according to claim 12 wherein said material is a flexible plastic.

19. A material according to claim 12 wherein said material is aluminum foil.

20. A material according to claim 13 wherein the angle between the base and the apex does not exceed 90°.

21. A material according to claim 13 wherein the angle between the base and the apex lies between 15° and 40°.

22. A material according to claim 12 wherein said sheet is oriented uniaxially along a predetermined line to be torn by stretching predominantly in a single direction.

23. A material according to claim 12 wherein said orientation enhances resistance to surface pressure without weakening the structure.

24. A material according to claim 12 wherein said uniaxial orientation includes preferential alignment of the molecules of said sheet material in a single direction along said predetermined line.

* * * * *